US007731674B2

(12) United States Patent
Ashihara et al.

(10) Patent No.: US 7,731,674 B2
(45) Date of Patent: Jun. 8, 2010

(54) WALKING ASSISTANCE DEVICE

(75) Inventors: Jun Ashihara, Wako (JP); Yutaka Hiki, Wako (JP); Hiroshi Kudoh, Wako (JP); Tatsuya Noda, Wako (JP); Yasushi Ikeuchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 91 days.

(21) Appl. No.: 12/161,719

(22) PCT Filed: Mar. 30, 2007

(86) PCT No.: PCT/JP2007/057062

§ 371 (c)(1),
(2), (4) Date: Jul. 22, 2008

(87) PCT Pub. No.: WO2008/001522

PCT Pub. Date: Jan. 3, 2008

(65) Prior Publication Data

US 2008/0318739 A1 Dec. 25, 2008

(30) Foreign Application Priority Data

Jun. 29, 2006 (JP) ..... 2006-179633

(51) Int. Cl.
*A61F 5/00* (2006.01)

(52) U.S. Cl. ..... 602/16; 602/19

(58) Field of Classification Search ..... 602/4, 602/5, 16, 19; 128/869; 482/51, 66
See application file for complete search history.

(56) References Cited

U.S. PATENT DOCUMENTS

| | | | | | |
|---|---|---|---|---|---|
| 4,872,665 | A | * | 10/1989 | Chareire | 482/51 |
| 5,476,441 | A | * | 12/1995 | Durfee et al. | 602/23 |
| 5,658,242 | A | * | 8/1997 | McKay et al. | 602/16 |
| 5,662,693 | A | * | 9/1997 | Johnson et al. | 607/49 |

FOREIGN PATENT DOCUMENTS

| | | |
|---|---|---|
| JP | 07-112035 | 5/1995 |
| JP | 2000-233002 | 8/2000 |
| JP | 2003-220102 | 8/2003 |
| JP | 2003-250844 | 9/2003 |
| JP | 2006-043871 | 2/2006 |
| WO | 2005/087172 | 9/2005 |

* cited by examiner

*Primary Examiner*—Michael A. Brown
(74) *Attorney, Agent, or Firm*—Rankin, Hill & Clark LLP

(57) ABSTRACT

A walking assistance device having a leg link connected to a load transmit portion via a first joint and to a foot attachment portion via a second joint, and having an intermediate third joint moving such that a distance between the first joint and the second joint is variable; a drive source for the third joint; and a battery for the drive source. When in an upstanding position, force in the forward-backward direction is prevented from acting on the load transmit portion to enhance stability. Also, a moment of inertia of the leg link is decreased to curtail a load applied to the leg of the user. The drive source and the battery are located at positions higher than the third joint, and when the user is in an upstanding position, a plane passing through the second joint lies between the drive source and the battery.

4 Claims, 4 Drawing Sheets

WALKING ASSISTANCE DEVICE

BACKGROUND OF THE INVENTION

1. Field of the Invention

The present invention relates to a walking assistance device for assisting a user in walking.

2. Description of the Related Art

Conventionally, as a type of walking assistance device, there is known one including a trunk attachment portion which is attached to a user's trunk, a thigh attachment portion which is connected to the trunk attachment portion via a hip joint portion corresponding to a human hip joint and attached to a thigh of a user's leg, a crus attachment portion which is connected to the thigh attachment portion via a knee joint portion corresponding to a human knee joint and attached to the crus of the user's leg, and a foot attachment portion which is connected to the crus attachment portion via an ankle joint portion corresponding to a human ankle joint and attached to a user's foot, wherein a drive source for driving each of the joint portions is provided coaxially with the respective joint portion (refer to Japanese Patent Laid-Open No. 2003-220102, for example). This type of walking assistance device is capable of assisting the user in walking by applying an assist moment from the drive source for driving the hip joint portion to the user's thigh via the thigh attachment portion, applying an assist moment from the drive source for driving the knee joint portion to the user's crus via the crus attachment portion, and applying an assist moment from the drive source for driving the ankle joint portion to the user's foot via the foot attachment portion.

The above-mentioned conventional walking assistance device is capable of assisting all movements of the user's thigh, crus, and foot. However, the user experiences a considerably constrained feeling as the thigh and the crus are restrained by the thigh attachment portion and the crus attachment portion. In addition, it is necessary to provide the drive sources for driving the joint portions such as the hip joint portion, the knee joint portion, and the ankle joint portion, respectively, which increases the cost disadvantageously.

In order to solve the above disadvantages, it is conceivable to provide a walking assistance device including a load transmit portion; a foot attachment portion attached to the user's foot; a leg link connected to the load transmit portion via a first joint portion located at an upper end thereof and connected to the foot attachment portion via a second joint portion located at a lower end thereof, and having a middle third joint portion which operates in such a way that a distance between the first joint portion and the second joint portion is variable; a drive source to drive the third joint portion, wherein a force generated for the leg link from the third joint portion driven by the drive source is transferred to the user's trunk via the load transmit portion. According thereto, the walking assistance device can assist walking by alleviating the load on the user's leg by means of the force from the leg link transferred to the user's trunk via the load transmit portion. Furthermore, it is possible to relieve the user of the constrained feeling by making the leg link free from the user's leg.

Meanwhile, it is also necessary to provide a battery for the drive source in the walking assistance device. Generally, it is conceivable that the battery is housed in a back pack shouldered by the user. However, this solution resultantly impairs the alleviation effect on the constraint feeling of the user. Therefore, it is desirable to provide a walking assistance device including a drive source for a third joint portion and a battery for the drive source without being shouldered in a back pack by the user.

However, in the above-mentioned case, since the drive source and the battery are both heavy loads, when the user stands upright, divergence of the center of gravity of the drive source and the battery to either a forward direction or a backward direction with respect to a frontal plane (a plane which is vertical and parallel to a transverse direction) passing through the lower second joint portion of the leg link generates a forward or backward tilt moment to the leg link with respect to the second joint portion as the center, which causes a forward or backward pushing force applied to the load transmit portion. Further, the moment of inertia around the first joint portion of the leg link may become great according to the disposed height of the drive source and the battery, which thereby increases a load applied to the free leg due to the moment of inertia of the leg link when a free leg of the user (a leg whose foot is off from the ground) swings forward.

SUMMARY OF THE INVENTION

The present invention has been accomplished in view of the aforementioned problems, and it is therefore an objective of the present invention to provide a walking assistance device which improves stability by preventing a pushing force in the anteroposterior direction from being applied to a load transmit portion in a state where a user stands upright, regardless of a drive source for a third joint portion of a leg link and a battery for the drive source are equipped thereon, and curtails the moment of inertia of the leg link by alleviating a load applied to the user's leg.

To attain the objectives described above, the walking assistance device according to the present invention which includes a load transmit portion; a foot attachment portion attached to a user's foot; a leg link connected to the load transmit portion via a first joint portion located at an upper end thereof and connected to the foot attachment portion via a second joint portion located at a lower end thereof, and having a middle third joint portion which operates in such a way that a distance between the first joint portion and the second joint portion is variable; a drive source to drive the third joint portion; and a battery for the drive source, in which a force generated for the leg link from the third joint portion driven by the drive source is transferred to the user's trunk via the load transmit portion, has the following characteristics.

Specifically, in a first aspect of the present invention, the drive source and the battery are disposed in such a way that a frontal plane passing through the second joint portion lies in an anteroposterior width of the drive source and an anteroposterior width of the battery in a normal state of the leg link in which the user stands upright. In a second aspect of the present invention, the drive source and the battery are disposed at the same height as or higher than the third joint portion.

According to the first aspect of the present invention, since the frontal plane passing through the second joint portion lies in the anteroposterior widths of the drive source and the battery in the state where the user stands upright, an anteroposterior offset distance of the center of gravity of each of the drive source and battery with respect to the frontal plane become shorter. Accordingly, the anteroposterior tilting moment which centers at the second joint portion and is generated according to the weights of the drive source and the battery and is applied to the leg link becomes smaller. Consequently, in the state where the user stands upright, an anteroposterior pushing force which is generated according to the tilting moment and applied to the load transmit portion becomes smaller, thereby improving the stability of the walking assistance device.

According to the second aspect of the present invention, the drive source and the battery are disposed at the same height as or higher than the third joint portion, in other words, are disposed close to the first joint portion, thereby making the moment of inertia around the first joint portion of the leg link smaller. Therefore, when the user swings the free leg, the load applied to the free leg due to the moment of inertia of the leg link can be alleviated.

It should be noted here that it is necessary to dispose the drive source at the leg link since it is needed to drive the third joint portion, while the battery may be disposed outside the leg link. Therefore, by providing the battery at the load transmit portion, the battery is separated from the leg link and the moment of inertia of the leg link according to the weight of the battery is curtailed, allowing the load applied to the user's free leg to be alleviated.

Meanwhile, the load transmit portion may be formed by a harness which is fixed to the user's waist. According to this configuration, the harness must be fixed tightly so as to certainly transfer the force from the leg link to the user's trunk, which thereby impairs the alleviation effect on the constraint feeling of the user. Regarding this problem, by constituting the load transmit portion from a seat member where the user sits astride, the force from the leg link can be transferred absolutely to the user's trunk from the user's crotch via the seat member. Moreover, it is only necessary for the user to sit on the seat member astride to use the walking assistance device; therefore, the constraint feeling on the user is considerably alleviated.

In this case, it is preferred that the first joint portion includes an arc-shaped guide rail which is longitudinal in an anteroposterior direction and has the center of curvature located above the seat member, and the center of curvature is configured to match the swing fulcrum of the leg link in the anteroposterior direction by movably engaging an upper end of the leg link movably engaged with the guide rail. According to this configuration, in cases where the action point of the weight of the user's upper body is deviated to the front of the swing fulcrum of the leg link in the anteroposterior direction with respect to the seat member, causing the seat member to incline anteroinferiorly, since the swing fulcrum of the leg link in the anteroposterior direction is located above the seat member, the action point of the weight is displaced backward under the swing fulcrum of the leg link in the anteroposterior direction, decreasing an anteroposterior distance between the fulcrum and the action point of the weight, which thereby decreases a rotation moment applied to the seat member. Therefore, the rotation moment applied to the seat member becomes zero when the action point of the weight is displaced to the position beneath the swing fulcrum of the leg link in the anteroposterior direction, which is a stable state for the seat member. Since the seat member automatically converges on the stable state, it is possible to prevent the seat member from deviating in the anteroposterior direction under the user's crotch.

If the first joint portion is configured to have an arc-shaped guide rail in this way, a space is formed between the underside of the seat member and the guide rail. Therefore, by disposing the battery on the underside of the seat member so as to be housed in the space, the space which would be a dead space between the seat member and the guide rail may be utilized effectively and reasonably.

DETAILED DESCRIPTION OF THE PREFERRED EMBODIMENTS

Figure 1:
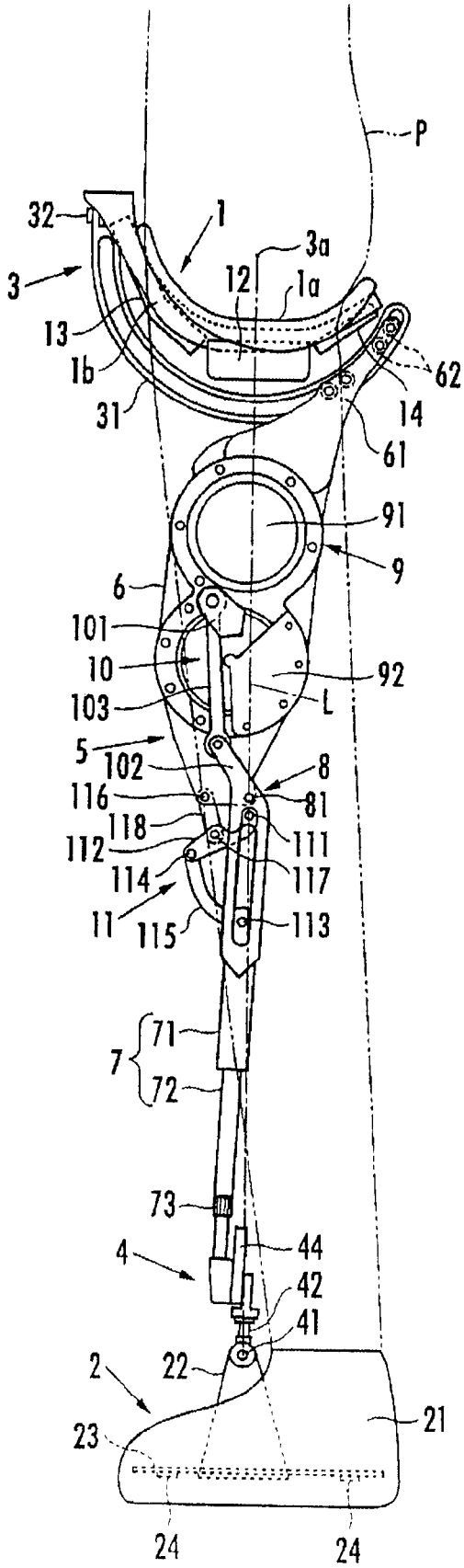
FIG. 1 is a side view of a walking assistance device according to an embodiment of the present invention.
Figure 2:
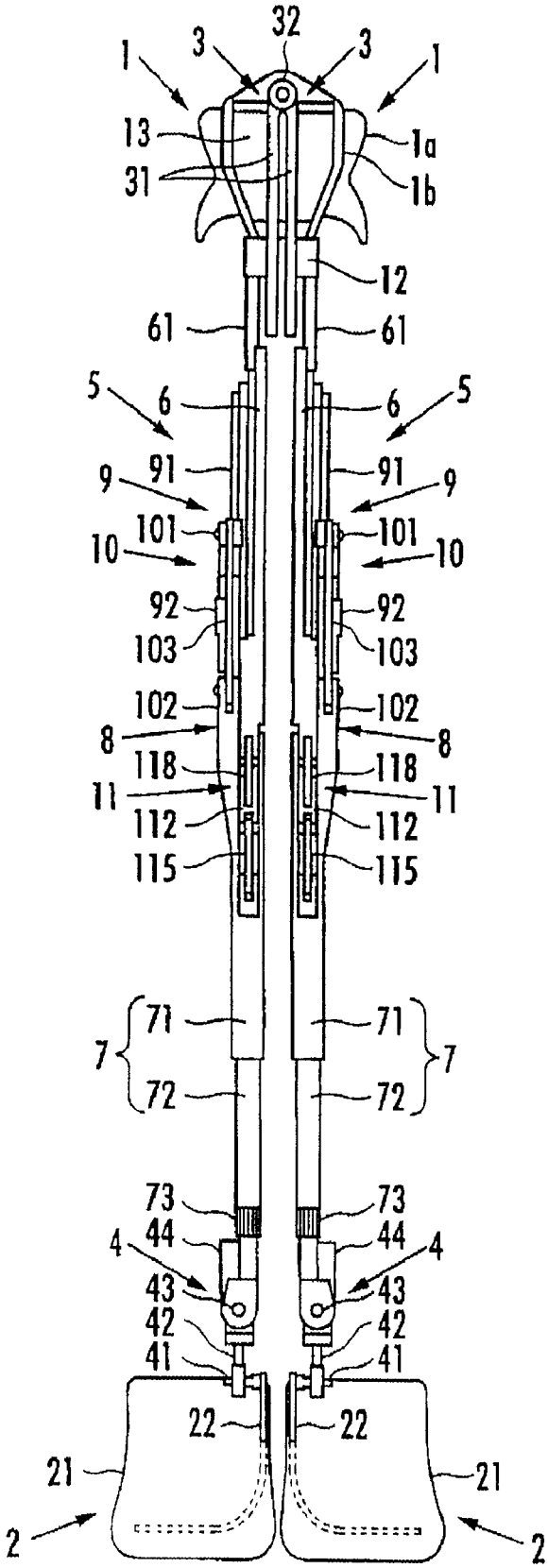
FIG. 2 is a front view of the walking assistance device according to an embodiment of the present invention.

A walking assistance device according to an embodiment of the present invention will be described hereinafter. As illustrated in FIG. 1 and FIG. 2, the walking assistance device includes a seat member 1 as a load transmit portion on which a user P sits astride, a pair of left and right foot attachment portions 2 and 2 which are attached to user's left and right feet, respectively, and a pair of left and right leg links 5 and 5 which are connected to the seat member 1 each via a first joint portion 3 located at the upper end and connected to the two foot attachment portions 2 and 2 each via a second joint portion 4 located at the lower end.

Each leg link 5 is composed of a freely bending and stretching link which varies a distance between the first joint portion 3 and the second joint portion 4. More specifically, each leg link 5 includes an upper first link portion 6 connected to the seat member 1 via the first joint portion 3 and a lower second link portion 7 connected to each foot attachment portion 2 via the second joint portion 4, which are connected by a third joint portion 8 of a rotary type in such a way that the leg link is free to bend and stretch. Each leg link 5 is equipped with a drive source 9 for the third joint 8. Then, a force in the direction of stretching each leg link 5 is applied to each leg link 5 by driving the third joint portion 8 by means of the drive source 9 to generate a supporting force which supports at least a part of the user's weight (hereinafter, referred to as a weight relief assist force). The weight relief assist force generated in each leg link 5 is transferred to the trunk of the user P via the seat member 1 and the load on the leg of the user P is thereby alleviated.

The user P can use the walking assistance device according to the present embodiment only by wearing the foot attachment portions 2 on his/her feet and sitting on the seat member 1, almost having no constrained feeling. Moreover, the first joint portions 3 and the leg links 5 are located under the crotch of the user P, therefore the user P does not hit his/her hands against the first joint portions 3 or the leg links 5 when swinging his/her arms in walking, which allows free arm swing. Furthermore, the walking assistance device is compact in size, enabling usage in a small place. Thereby, the usability is remarkably improved in addition to the alleviation of the constrained feeling and the secured free arm swing.

The seat member 1 is composed of a saddle-shaped seat portion 1*a* which the user P sits on and a support frame 1*b* which supports the seat portion 1*a* on the underside thereof. In addition, each first joint portion 3 for each leg link 5 has an arc-shaped guide rail 31 which is longitudinal in the anteroposterior direction provided on the downside of the seat member 1. Then, each leg link 5 is movably engaged with the guide rail 31 via a plurality of rollers 62 pivotally attached to a slider 61 which is fixed to the upper end of the first link portion 6. In this way, each leg link 5 swings in the anteroposterior direction around the center of curvature of the guide rail 31 and the anteroposterior swing fulcrum of each leg link 5 functions as the center of curvature of the guide rail 31.

Referring to FIG. 1, the center of curvature of the guide rail 31, namely the anteroposterior swing fulcrum 3*a* of each leg link 5 in each first joint portion 3 is located above the seat member 1. If the user P tilts his/her upper body forward or the like, causing the action point of the weight of the upper body of the user P deviated forward of the anteroposterior swing fulcrum 3*a* of each leg link 5 with respect to the seat member 1, the seat member 1 inclines anteroinferiorly. Moreover, the seat member 1 will deviate backward with respect to the user P if the seat member 1 continues to incline further. In the present embodiment, however, the action point of the weight is displaced backward under the swing fulcrum 3*a* along with the anteroposterior inclination of the seat member 1 and thereby an anteroposterior distance between the fulcrum 3*a* and the action point of the weight decreases, which thereby decreases the rotation moment applied to the seat member 1. Thereafter, the rotation moment applied to the seat member 1 becomes zero when the action point of the weight is displaced to the position beneath the swing fulcrum 3*a*, which is a stable state for the seat member 1. Since the seat member 1 automatically converges on the stable state as described above, it is possible to prevent the seat member 1 from deviating in the anteroposterior direction under the crotch of the user P.

Furthermore, the slider 61, which is located at the upper end of each leg link 5, engages with a part of the guide rail 31, which is located backward of a line between the third joint portion 8 of the leg link 5 and the anteroposterior swing fulcrum 3*a* (the center of curvature of the guide rail 31) of the leg link 5. This secures a forward swing stroke of each leg link 5 that follows the forward swing motion of each leg of the user P without increasing the length of the guide rail 31 so much.

Furthermore, the guide rails 31 for the left and right leg links 5 are pivotally supported by the support frame 1*b* of the seat member 1 via an anteroposterior spindle 32. Therefore, the guide rails 31 are connected to the seat member 1 so as to swing freely in the lateral direction. The leg links 5 are therefore allowed to swing in the lateral direction, which enables the user P to abduct his/her legs.

Each foot attachment portion 2 has a shoe 21 and a joint member 22 protruding upward from the inside of the shoe 21. Moreover, the second link portion 7 of each leg link 5 is connected to the joint member 22 via the second joint portion 4. The second joint portion 4 is formed to be a three-axis structure having a first shaft 41 extending in the lateral direction, a second shaft 42 extending in the vertical direction, and a third shaft 43 extending in the anteroposterior direction. In addition, the second joint portion 4 is incorporated with a two-axis force sensor 44. Note here that the above-mentioned weight relief assist force is applied onto a line (hereinafter, referred to as a reference line) L between the anteroposterior swing fulcrum 3*a* of the leg link 5 in the first joint portion 3 and the first shaft 41 which is an anteroposterior swinging fulcrum of the leg link 5 in the second joint portion 4 in profile. Then, an actual weight relief assist force applied onto the reference line L (accurately, a resultant force between the weight relief assist force and a force generated by the weights of the seat member 1 and the leg links 5) is calculated based on detected values of forces in the two-axis direction detected by the force sensors 44.

Furthermore, as illustrated in FIG. 1, a pair of anteroposterior pressure sensors 24, 24, which detect loads on the metatarsophalangeal joint (MP joint) and the heel of each foot of the user P, are attached to the undersurface of an insole 23 provided in the shoe 21. In assisting walking, first, a ratio of the load applied to each foot to the total load applied to both feet of the user is calculated based on the detected values detected by the pressure sensors 24, 24 of each foot attachment portion 2. Subsequently, a control target value of the weight relief assist force which should be generated by each leg link 5 is calculated by multiplying a preset value of the weight relief assist force by the load ratio of each foot. Then, the drive source 9 is controlled so that the actual weight relief assist force calculated based on the detected values of the above force sensor 44 reaches the control target value.

Note here that the drive source 9 is disposed in the leg link 5, and on the other hand, the drive source 9 is a heavy load. Therefore, an increase in distance between the drive source 9 and the anteroposterior swing fulcrum 3*a* of the leg link 5 in the first joint portion 3 leads to an increase in distance between the swing fulcrum 3*a* and the center-of-gravity of the entire leg link 5 including the drive source 9. In consequence, the moment of inertia of the leg link 5 around the swing fulcrum 3*a* grows, which leads to an increase in load applied to the free leg due to the moment of inertia of the leg link 5 when the user P swings the free leg (the leg with the foot off from the ground) forward. Therefore, in the present embodiment, the drive source 9 is disposed in such a way that the center-of-gravity is located upper than the third joint portion 8 of the first link portion 6 so that the center-of-gravity of the entire leg link 5 including the drive source 9 is located upper than the third joint portion 8. This decreases the distance between the center-of-gravity of the entire leg link 5 and the swing fulcrum 3*a* and curtails the moment of inertia of the leg link 5 around the swing fulcrum 3*a*, whereby the load on the free leg of the user P is alleviated.

In addition, "the center-of-gravity of the entire leg link located upper than the third joint portion 8" means that the mass of the first link portion 6 is greater than that of the second link portion 7. Note here that the thigh of a human leg is heavier than the crus thereof. By locating the center-of-gravity of the entire leg link 5 upper than the third joint portion 8, the mass ratio between the first link portion 6 and the second link portion 7 of the leg link 5 gets closer to the mass ratio between the thigh and the crus of the human leg. In addition, the length ratio between the first link portion 6 and the second link portion 7 is substantially equal to the length ratio between the thigh and the crus of the human leg. Therefore, the total natural frequency of the user's free leg and the leg link 5 which moves following the user's free leg, has a value close to the natural frequency of the free leg alone, and as a result, the user can move the free leg without uncomfortable feeling.

In the present embodiment, the drive source 9 includes an electric motor 91 and a planetary gear type reduction gear 92. In this instance, it is conceivable that the electric motor 91 and the reduction gear 92 are disposed coaxially in the vicinity of the upper end of the first link portion 6. However, there is a limit to the lateral thickness of the leg link 5 in preventing interference with the leg of the user P. Therefore, if the electric motor 91 and the reduction gear 92 are disposed coaxially with each other, the drive source 9 may hit the leg of the user P due to the thickness limit of the leg link 5 surpassed by the thickness of the disposed portion of the drive source 9. Therefore, in the present embodiment, the electric motor 91 and the reduction gear 92 are disposed in the first link portion 6 in such a way that the electric motor 91 is located upper than the reduction gear 92. According thereto, the electric motor 91 heavier than the reduction gear 92 is closer to the swing fulcrum 3*a* than the reduction gear 92. Therefore, the moment of inertia of the leg link 5 around the swing fulcrum 3*a* can be curtailed effectively.

Figure 3:
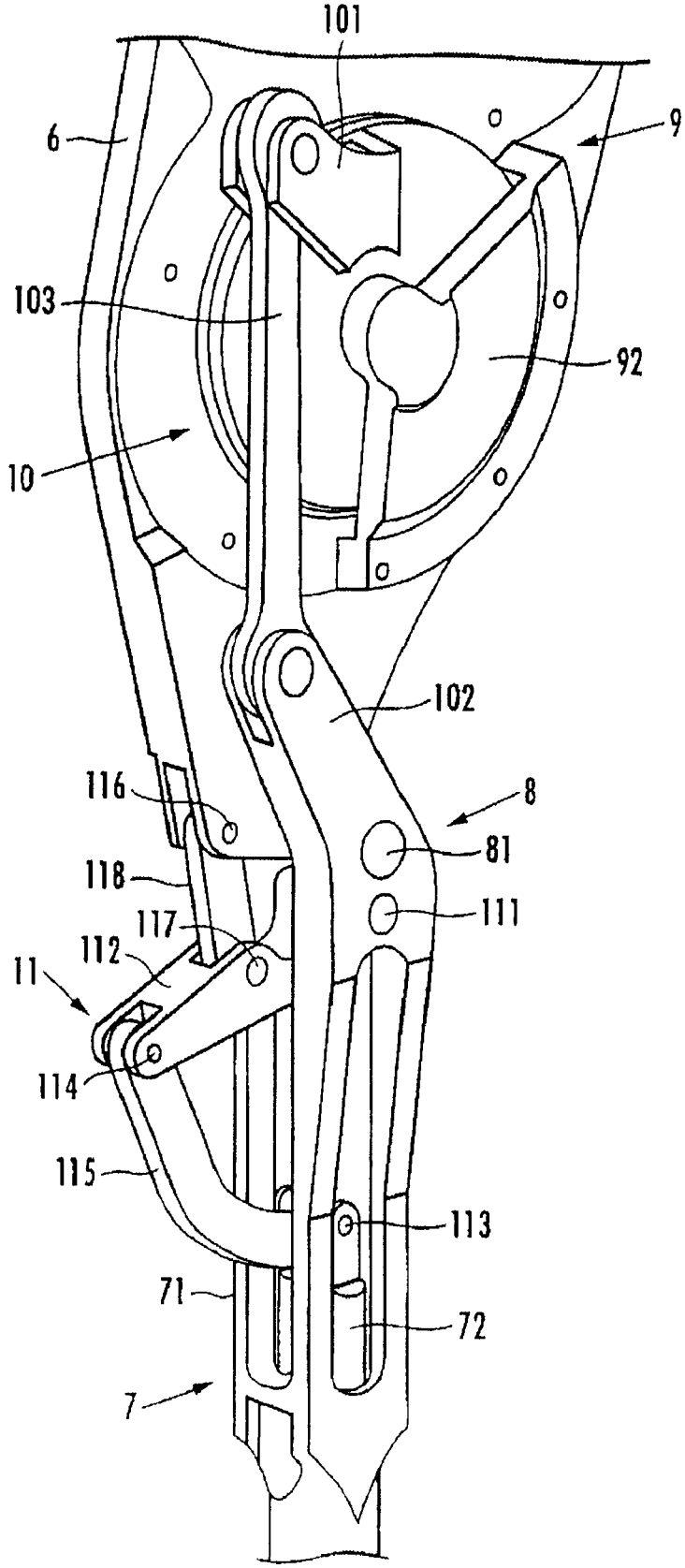
FIG. 3 is a neighborhood perspective view of a third joint portion of a leg link of the walking assistance device according to an embodiment of the present invention.
Figure 4:
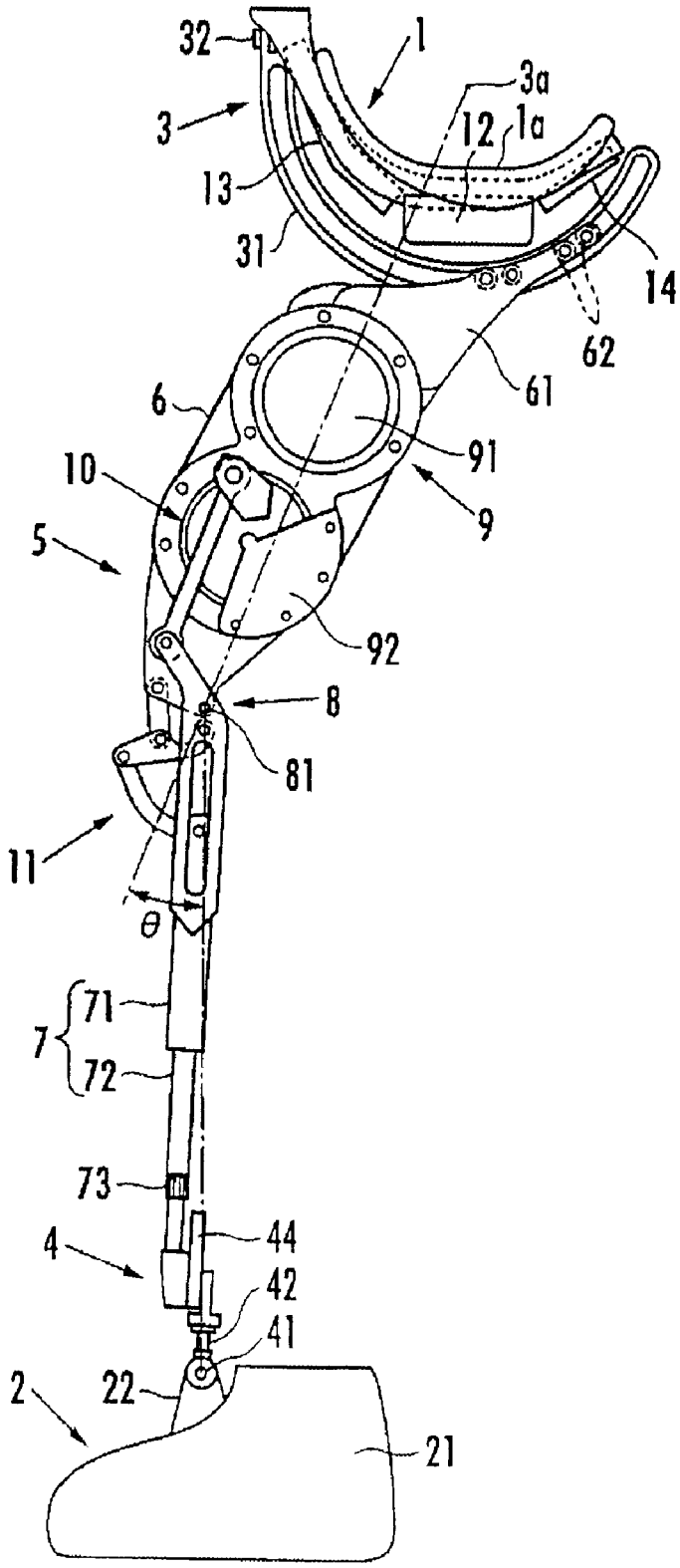
FIG. 4 is side view of the walking assistance device according to an embodiment of the present invention when the leg link is inflected.

The third joint portion 8 is driven by the electric motor 91 via the reduction gear 92 and a power transmission system 10, which will be described in detail with reference to FIG. 3. The third joint portion 8 is formed with the upper end of the second link portion 7 pivotally attached to the lower end of the first link portion 6 via a joint shaft 81 disposed laterally. Furthermore, the power transmission system 10 includes a first crank arm 101 which is provided on the output side of the reduction gear 92, a second crank arm 102 which extends upward from the joint shaft 81 and is integral to the second link portion 7, and a rod 103 which connects the crank arms 101 and 102 to each other. According thereto, the rotation output of the reduction gear 92 is transferred to the second crank arm 102 via the first crank arm 101 and the rod 103, the second link portion 7 swings around the joint shaft 81 with respect to the first link portion 6, and the leg link 5 is bent as illustrated in FIG. 4 from the extended state illustrated in FIG. 1.

However, if the leg link 5 is bent in a state where the leg of the user P is extending straight, the third joint portion 8 protrudes forward of the knee joint of the user P, which exerts an uncomfortable feeling on the user P. Therefore, in the state where the leg of the user P is extending straight, it is desirable that the joint shaft 81 of the third joint portion 8 is located on the reference line L so that the flexion angle θ of the third joint portion 8 is zero degree, in other words, the leg link 5 is in an extended state as illustrated in FIG. 1.

In this regard, if the leg link 5 is a simple bending and stretching link, the extension speed of the leg link 5, which is obtained by differentiating the length of a line segment between the swing fulcrum 3*a* of the leg link 5 in the first joint portion 3 and the first shaft 41 of the second joint portion 4 with respect to the flexion angle θ of the third joint portion 8, becomes zero when the flexion angle θ becomes zero degree. Therefore, if the flexion angle θ becomes zero degree, the walking assisting device loses the controllability in the direction of extending the leg link 5, in other words, in the direction of pushing up the seat member 1. Accordingly, even if there is an increase in the weight relief assist force which should be generated in the leg link 5 on a standing leg side when the user P shifts from a state of standing upright on two legs to another state of standing on one leg, it is impossible to appropriately control the weight relief assist force if the standing leg extends straight and the third joint portion 8 of the leg link 5 on the standing leg side has the flexion angle θ of zero degree.

Therefore, in the present embodiment, the second link portion 7 of the leg link 5 is telescopically formed by an upper half portion 71 of a cylindrical shape which is connected to the third joint portion 8 and a lower half portion 72 which is slidably inserted into the upper half portion 71 and supported thereby, and it is further provided with an interlock system 11 which extends and retracts the second link portion 7 in conjunction with the operation of increasing and decreasing the flexion angle θ of the third joint portion 8. Then, the interlock system 11 is adapted so that the extension speed of the second link portion 7 does not become zero even if the flexion angle θ is brought to zero degree where the extension speed is obtained by differentiating the length of the second link portion 7 with respect to the flexion angle θ of the third joint portion 8.

According thereto, the extension speed of the leg link 5 does not become zero even when the flexion angle θ is zero degree. Therefore, even though the flexion angle θ becomes zero degree, the controllability in the direction of pushing up the seat member 1 is maintained and the weight relief assist force can be appropriately controlled in response to a change in load. Consequently, it becomes possible to cause the flexion angle of the third joint portion 8 to be zero degree in the state where the leg of the user P is extending straight, in other words, to cause the leg link 5 to be extended, and therefore the user P can use the walking assistance device without feeling uncomfortable. In addition, the lower half portion 72 is adjustable to an arbitrary length by using a lock nut 73. Therefore, the length of the leg link can be adjusted in response to that of the leg of the user P.

In this regard, it is also possible to provide a drive source for extending and retracting the second link portion 7 which moves the lower half portion 72 of the second link portion 7 up and down with respect to the upper half portion 71 and a sensor for detecting the flexion angle θ of the third joint portion 8 in order to form an interlock system so that the lower half portion 72 of the second link portion 7 is moved up and down by actuating the drive source for extension and retraction according to a signal from the sensor. This, however, increases the cost and the total weight of the leg link due to the effect of the drive source for extension and retraction. Therefore, in the present embodiment, the interlock system 11 is formed by a mechanical system which converts the rotary motion around the third joint portion 8 of the upper half portion 71 of the second link portion 7 with respect to the first link portion 6 to a linear motion of the lower half portion 72 of the second link portion 7 so as to curtail the cost and to hold down the increase in the total weight of the leg link 5.

More specifically, the interlock system 11 is a link mechanism consisting of a first interlocking link 112 with one end pivotally mounted on the upper half portion 71 of the second link portion 7 by a shaft 111, a second interlocking link 115 with one end pivotally mounted on the lower half portion 72 of the second link portion 7 by a shaft 113 and the other end pivotally mounted on the other end of the first interlocking link 112 by a shaft 114, and a third interlocking link 118 with one end pivotally mounted on the first link portion 6 by a shaft 116 and the other end pivotally mounted on the middle portion of the first interlocking link 112 by a shaft 117. According thereto, a quadrilateral shape, which is formed by the joint shaft 81 of the third joint portion 8, the shaft 111, the shaft 117, and the shaft 116, deforms by a displacement of the shaft 111 caused by the rotary motion around the third joint portion 8 of the upper half portion 71 of the second link portion 7 with respect to the first link portion 6, and this deformation causes a change in an angle between a line segment connecting the shaft 114 to the shaft 111 and a line segment connecting the shaft 114 to the shaft 113. This change in the angle causes a change in distance between the shaft 111 and the shaft 113 and thereby the lower half portion 72 of the second link portion 7 linearly moves in a longitudinal direction (vertical direction) of the upper half portion 71 with respect thereto. If the flexion angle θ of the third joint portion 8 decreases, the lower half portion 72 moves downward as illustrated in FIG. 1 and thereby the length of the second link portion 7 increases. If the flexion angle θ increases, the lower half portion 72 moves upward as illustrated in FIG. 4 and thereby the length of the second link portion 7 decreases. Note that the interlock system 11 is not limited to the link mechanism of the present embodiment; it can be formed by a cam mechanism or a rack and pinion mechanism.

Where the first joint portion 3 is formed into one having an arc-shaped guide rail 31 as described above, a space is generated between the guide rail 13 and the underside of the seat member 1. Therefore, in order to use the space effectively, a battery 12 for the drive source 9, a controller 13, and a motor driver 14 are disposed in the support frame 1*b* of the seat member 1 in such a way as to fit into the space between the seat member 1 and the guide rail 31.

In this regard, it is desired that the drive source 9, which is a heavy load, is disposed in a position equal to or higher than the third joint portion 8 in order to reduce the moment of inertia around the swing fulcrum 3*a* in the first joint portion 3 of the leg link 5. Therefore, in the present, embodiment the drive source 9 is located upper than the third joint portion 8 of the first link portion 6 as described above. Furthermore, the battery 12, which is a heavy load, is also disposed in the seat member 1 higher than the third joint portion 8. However, if the drive source 9 and the battery 12 are located in higher positions in this manner, it is easy for the weight of the drive source 9 and that of the battery 12 to generate an tilting moment in the anteroposterior direction around the first shaft 41 of the second joint portion 4 in the leg link 5 in the state where the user P stands upright, and the tilting moment causes a pushing force in the anteroposterior direction to be applied to the seat member 1.

Therefore, in the present embodiment, the walking assistance device is adapted to prevent the tilting moment from being generated. In this regard, the state of the leg link 5 in which the user P stands upright is defined as a normal state (the state as illustrated in FIG. 1) in the following description. In the normal state of the leg link 5, the drive source 9 and the battery 12 which are heavy loads are configured in such a way that a plane, which is vertical and parallel to the lateral direction and passes through the first shaft 41 of the second joint portion 4, in other words, a frontal plane (in the present embodiment, the frontal plane substantially matches the above reference line L) lies in the anteroposterior width of the drive source 9 and the anteroposterior width of the battery 12. This reduces an anteroposterior offset distance of the center-of-gravity of the drive source 9 and that of the center-of-gravity of the battery 12 with respect to the above mentioned frontal plane. Therefore, in the normal state of the leg link 5, the configuration reduces the anteroposterior tilting moment around the first shaft 41 of the second joint portion 4 generated in the leg link 5 by the weight of the drive source 9 and that of the battery 12. Consequently, the anteroposterior pushing force applied to the seat member 1 due to the tilting moment is also reduced in the state where the user P stands upright, thereby improving the stability of the walking assistance device.

It is also possible to dispose the battery 12 in the first link portion 6 of the leg link 5. However, if the battery 12 is disposed in the seat member 1 as described in the present embodiment, the mass of the battery 12 is not added to the leg link 5, therefore it is advantageous that the moment of inertia of the leg link 5 can be reduced as much as possible.

Although the embodiment of the present invention has been explained above in relation to the preferred embodiments and drawings, the present invention is not limited thereto. For example, although each leg link 5 is formed by an extensible and retractable link having a rotary-type third joint portion 8 in the middle of the leg link 5 in the above embodiment, the leg link can be formed alternatively by an extensible and retractable link having a direct-acting type third joint portion. Furthermore, although the load transmit portion is formed by the seat member 1 in the above mentioned embodiment, the load transmit portion can be formed by a harness to be attached around the user's waist. Moreover, to assist a user who is handicapped in one leg due to a fracture or the like of the leg in walking, it is possible to leave only the leg link of the left and right leg links 5, 5 in the above embodiment corresponding to the side of the user's handicapped leg while removing the other leg link.

What is claimed is:

1. A walking assistance device, comprising:

a load transmit portion;

a foot attachment portion attached to a user's foot;

a leg link connected to the load transmit portion via a first joint portion located at an upper end thereof and connected to the foot attachment portion via a second joint portion located at a lower end thereof, and having a middle third joint portion which operates in such a way that a distance between the first joint portion and the second joint portion is variable;

a drive source to drive the third joint portion; and a battery for the drive source, wherein a force generated for the leg link from the third joint portion driven by the drive source is transferred to a user's trunk via the load transmit portion, wherein the drive source and the battery are disposed in such a way that a frontal plane passing through the second joint portion lies in an anteroposterior width of the drive source and an anteroposterior width of the battery in a normal state of the leg link where a user stands upright.

2. A walking assistance device, comprising:

a load transmit portion;

a foot attachment portion attached to a user's foot;

a leg link having a first joint portion which is connected to the load transmit portion via an upper end thereof, a second joint portion which is connected to the foot attachment portion via a lower end thereof and a middle third joint portion which operates in such a way that a distance between the first joint portion and the second joint portion is variable;

a drive source to drive the third joint portion; and a battery for the drive source, wherein a force generated for the leg link from the third joint portion driven by the drive source is transferred to a user's trunk via the load transmit portion, wherein the drive source and the battery are disposed at the same height as or higher than the third joint portion.

3. The walking assistance device according to claim 2, wherein the drive source is disposed at the load transmit portion.

4. The walking assistance device according to claim 3, wherein the load transmit portion is composed of a seat member on which a user sits astride;

the first joint portion includes an arc-shaped guide rail which is longitudinal in an anteroposterior direction and has the center of curvature located above the seat member, and the center of curvature is configured to match the swing fulcrum of the leg link in the anteroposterior direction by movably engaging an upper end of the leg link with the guide rail; and the battery is disposed on an underside of the seat member so as to be housed in a space formed between the underside of the seat member and the guide rail.

* * * * *